US006412456B2

(12) United States Patent
Kumaki et al.

(10) Patent No.: US 6,412,456 B2
(45) Date of Patent: Jul. 2, 2002

(54) CONTROL SYSTEM OF ELECTROMAGNETICALLY OPERATED VALVE

(75) Inventors: Hiroshi Kumaki; Ikuhiro Taniguchi, both of Kanagawa; Taketoshi Kawabe, Yokohama; Shigeru Nakajima, Kanagawa, all of (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/854,480

(22) Filed: May 15, 2001

(30) Foreign Application Priority Data

Jun. 2, 2000 (JP) ..... 2000-166532

(51) Int. Cl.[7] ..... F01L 9/04

(52) U.S. Cl. ..... 123/90.11; 251/129.1; 335/255

(58) Field of Search ..... 123/90.11, 90.15, 123/90.19; 251/129.1, 129.15, 129.16; 335/255, 256; 73/119 R, 118.1

(56) References Cited

U.S. PATENT DOCUMENTS 4,905,506 A * 3/1990 Lebershausen ..... 73/118.1

6,047,672 A * 4/2000 Hanai ..... 123/90.11

FOREIGN PATENT DOCUMENTS

JP 11-159313 6/1999

* cited by examiner

*Primary Examiner*—Thomas Denion
*Assistant Examiner*—Jaime Corrigan
(74) *Attorney, Agent, or Firm*—Foley & Lardner

(57) ABSTRACT

A valve control system for controlling an electromagnetic valve unit is arranged to detect a characteristic of a free vibration of a vibration system in the electromagnetic valve unit when a pair of electromagnets of the electromagnetic valve unit are de-energized and to estimate at least one of a friction quantity and a spring constant of the vibration system on the basis of the detected characteristic of the free vibration. The control system executes the control of the electromagnetic valve unit on the basis of a control parameter determined by one of the estimated friction quantity and the estimated spring constant. This arrangement improves a certainty of softly landing a movable member of the electromagnetic valve unit on the electromagnets.

13 Claims, 9 Drawing Sheets

CONTROL SYSTEM OF ELECTROMAGNETICALLY OPERATED VALVE

BACKGROUND OF THE INVENTION

The present invention relates to a control system for controlling an electromagnetically operated valve, and more particularly to an electromagnetic valve control system which is capable of executing a soft landing of a movable member onto an electromagnet in a valve open/close control.

Lately, there are proposed various electromagnetic valve operating systems that employ an electromagnetic actuator comprised of a movable member, a pair of electromagnets and a pair of springs so as to reciprocatingly operate intake and exhaust valves of an internal combustion engine. Generally, it is preferable that a movable member of such a valve operating system is softly landed on an electromagnet while ensuring a required motion performance. A Japanese Patent Provisional Publication No. (Heisei)11-159313 discloses a landing method for softly landing a movable member on an electromagnet in an electromagnetic valve operating system. Such soft landing in this system is achieved by temporally switching off the electromagnet during a period between a switch-on moment of the electromagnet and the landing moment of the movable member. Further, in order to realize a further accurate landing control of an electromagnetic valve unit including a valve and an electromagnetic actuator, there is proposed a control method employing a characteristic representative of a vibration system of the electromagnetic valve unit.

SUMMARY OF THE INVENTION

However, the characteristic of the vibration system of the controlled electromagnetic valve unit is varied according to an operating condition. Particularly, a friction in the electromagnetic valve unit is largely affected by a temperature since the friction largely depends on a characteristic of rubricating oil whose viscosity is varied according to the change of temperature. Therefore, it is difficult to stably execute a required landing control only by a preset characteristic representative quantity.

It is therefore an object of the present invention to provide a control system for certainly executing a soft landing control of an electromagnetic valve unit by employing an actual characteristic of a vibration system of the electromagnetic valve unit.

An aspect of the present invention resides in a valve control system comprising an electromagnetic valve unit and a controller. In this system, the electromagnetic valve unit comprises a valve, a pair of electromagnets arranged in spaced relationship from one another in axial alignment with the valve so as to form a space, a movable member axially movably disposed in the space between the electromagnets and interlocked with the valve, and a pair of springs biasing the movable member so as to locate the movable member at an intermediate portion of the space when both of the electromagnets are de-energized. The controller is connected to the electromagnetic valve unit and energizes and de-energizes each of said electromagnets to reciprocatingly displace the valve. The controller is arranged to detect a characteristic of a free vibration of a vibration system in the electromagnetic valve unit when both electromagnets are de-energized, and to estimate at least one of a friction quantity and a spring constant of the vibration system on the basis of the detected characteristic of the free vibration.

Another aspect of the present invention resides in a method for controlling an electromagnetic valve unit, the electromagnetic valve unit being arranged to operate a valve by electromagnetically controlling a pair of electromagnets so as to displace a movable member disposed in a space between the electromagnets which receiving biasing force of a pair of springs. The method comprises detecting a characteristic of a free vibration of a vibration system in the electromagnetic valve unit when both electromagnets are de-energized; and estimating at least one of a friction quantity and a spring constant of the vibration system on the basis of the detected characteristic of the free vibration.

DETAILED DESCRIPTION OF THE INVENTION

Referring to FIGS. 1 to 13, there is shown an embodiment of a control system for electromagnetically operated engine valves in accordance with the present invention.

Figure 1:
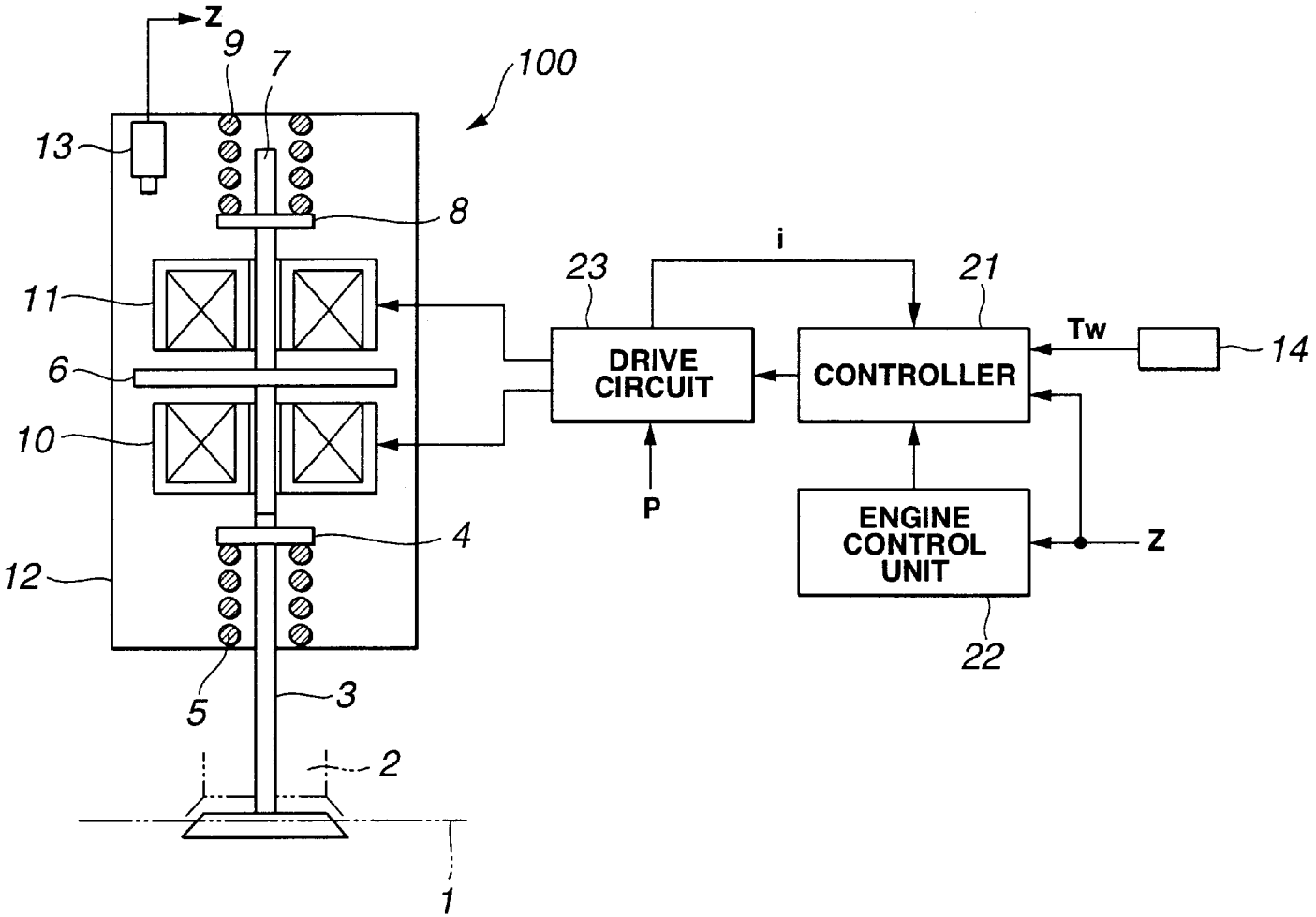
FIG. 1 is a schematic view showing a control system of electromagnetically operated engine valve according to an embodiment of the present invention.

As shown in FIG. 1, the control system according to the present invention is adapted to control intake and exhaust valves of an internal combustion engine for an automotive vehicle. Four valve units 100 are provided by each cylinder of the engine. Two of valve units 100 perform as intake valves, and the other two of valve units 100 perform as exhaust valves. More specifically, by each cylinder of the engine, two intake ports communicated with an intake passage and two exhaust ports are formed in a cylinder head 1. In order to facilitate the explanation the structure of the valve units 100, one of the valve units 100 will be discussed.

A valve 3 of each valve unit 100 is installed to one port 2 of intake and exhaust ports. Valve 3 penetrates a lower wall of a housing 12, and is reciprocally movable while being supported by cylinder head 1. A retainer 4 is fixed to a top end portion of valve 3. A valve closing spring 5 is installed between retainer 4 and a wall of cylinder head 1 faced with retainer 4, and biases valve 3 into a valve closing direction.

A plate-like movable member 6 made of soft magnetic material is integrally connected to a guide shaft 7. A lower tip end of guide shaft 7 is in contact with an upper end of valve 3. A retainer 8 is fixed to an upper portion of guide shaft 7. A valve opening spring 9 is installed between retainer 8 and an upper wall of housing 12. Valve opening spring 9 biases movable member 6 integral with guide shaft 7 into the valve opening direction, and therefore valve 3 is biased into the valve opening direction by valve opening spring 9 through guide shaft 7. Accordingly, valve 3 and movable member 6 are integrally movable in reciprocating motion. When valve 3 and movable member 6 are put in the contacted state, valve closing and opening springs 5 and 9 bias movable member 6 at a neutral position shown in FIG. 1. Although this embodiment according to the present invention has been shown and described such that a shaft of valve 3 is separable from guide shaft 7, it will be understood that valve 3 and guide shaft 7 are integrally formed.

A valve opening electromagnet 10 is disposed below movable member 6 while having a predetermined clearance from movable member 6, and a valve closing electromagnet 11 is disposed above movable member 6 while having a predetermined clearance from movable member 6. Therefore, movable member 6 is movably disposed in a space between valve opening and closing electromagnets 10 and 11. Both valve opening and closing electromagnets 10 and 11 have guide holes respectively, and guide shaft 7 is reciprocatingly supported to these guide holes. The neutral position of movable member 6 is located at a generally center (intermediate) position between valve opening and closing electromagnets 10 and 11.

A position sensor 13 is installed in housing 12 and detects a position of movable member 6 in the axial direction. In this embodiment, a laser displacement meter is employed as position sensor 13.

A controller 21 of the valve control system receives a valve opening/closing command from an engine control unit 22 and outputs an energizing signal to a drive circuit 23 on the basis of the received valve opening/closing command to energize valve opening electromagnet 10 or valve closing electromagnet 11. Drive circuit 23 supplies electric current from an electric source (not-shown) to each electromagnet 10, 11 so as to apply suitable electromagnetic force to movable member 6.

Further, controller 21 receives a temperature signal indicative of a lubrication oil temperature from a temperature sensor 14 and a current i to be supplied to each electromagnet 10, 11 from drive circuit 23. In this embodiment, a coolant temperature signal Tw indicative of an engine coolant temperature is inputted to controller 21 as a temperature corresponding to lubrication oil temperature.

Next, the manner of operation of valve unit 100 will be discussed.

Dimensions and spring constants of the respective valve closing and opening springs 5 and 9 have been designed so that movable member 6 is positioned at the neutral position due to the biasing forces of springs 5 and 9 and when both electromagnets 10 and 11 are de-energized.

When the operation of movable member 6 is started, an initialization control for positioning movable member 6 at a seated (landing) position on valve closing electromagnet 11 is executed in order to decrease energy consumption and to lower a production cost of a current supply circuit of electromagnets 10 and 11. The initialization control employed in this embodiment is a known method in that an amplitude of alternative displacement is gradually increased by alternatively supplying electric current to electromagnets 10 and 11 and at last movable member 6 reaches a predetermined initial position corresponding to the valve full close position.

Normal valve operation of each of intake and exhaust valves is started after completing the initialization control. For example, when valve 3 put in a closed position is moved to an opened position, valve closing electromagnet 11 is first de-energized. In reply to the de-energizing operation of valve closing electromagnet 11, movable member 6 is basically displaced downward due to the forces of springs 5 and 9. Movable portions of valve unit 100 generates energy loss due to some friction based on a viscosity of lubrication oil. In order to cancel this energy loss and to maintain the normal valve operation, valve opening electromagnet 10 is energized during an opening process of movable member 6.

Figure 2:
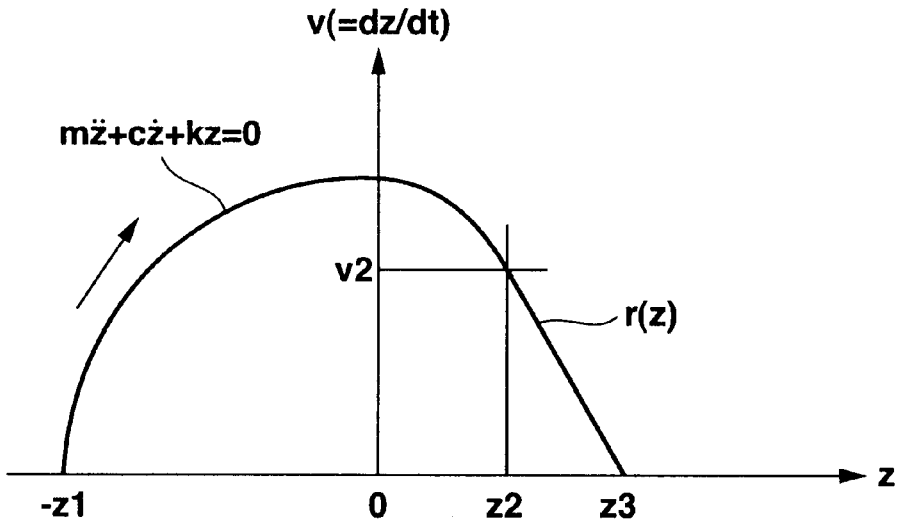
FIG. 2 is a movable member velocity function employed in a landing control by the control system of FIG. 1.

A graph of FIG. 2 shows a locus of movable member 6. In this graph, a horizontal axis represents a position z of movable member 6 when the neutral position of movable member 6 is set at an origin point, and a vertical axis represents a velocity v of movable member 6 at the position z. By de-energizing valve closing electromagnet 11, movable member 6 to have been attracted by valve closing electromagnet 11 starts free vibration from a position z=−z1 (where z1>0). In this situation, the motion in this spring-mass-damper vibration system is generally determined by the following equation (1).

$$m\ddot{z}+c\dot{z}+kz=0 \tag{1}$$

In this equation (1), c is a damping coefficient and particularly denotes a magnitude of friction.

At the moment when movable member 6 is displaced to a position where magnetic force of valve opening electromagnet 10 becomes effective to movable member 6, valve opening electromagnet 10 is energized. Movable member 6 is biased by this magnetic force of valve opening electromagnet 10 and is displaced to a predetermined position (z=z3). By supplying a predetermined electric current to valve opening electromagnet 10 during this period, movable member 6 is accelerated as movable member 6 approaches valve opening electromagnet 10. In order prevent a radial collision between movable member 6 and valve opening electromagnet 10, a landing control for softly landing movable member 6 on valve opening electromagnet 10 is executed by decelerating the velocity v of movable member 6.

Figure 3:
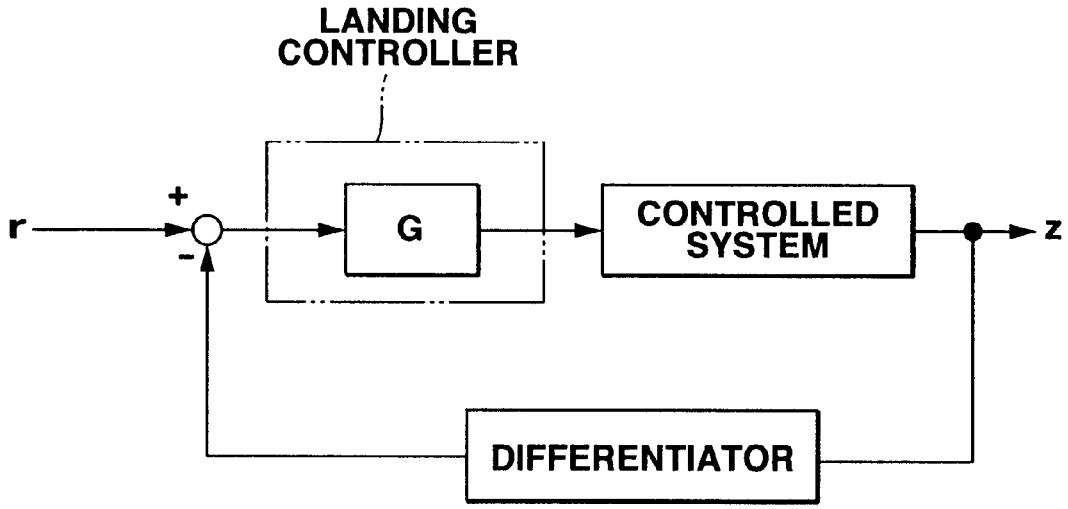
FIG. 3 is a block diagram of a feedback control system of the valve control system schematic view showing an embodiment of the present invention.

In order to achieve this landing control (collision preventing control), velocity v of movable member 6 after starting energizing valve opening electromagnet 10 is controlled at a target velocity r according to the position z by means of a feedback control, as shown in FIG. 3. In this control system, controller 21 detects velocity v of movable member 6 and outputs the energizing command so that the detected velocity v follows up the target velocity r. By energizing valve opening electromagnet 10 through drive circuit 23 according to the energizing current, it becomes possible to land movable member 6 on valve opening electromagnet 10 at a predetermined velocity such as 0.1 (m/s) or less. Further, it becomes possible to stop movable member 6 at a position where movable member 6 has a predetermined gap with respect to valve opening electromagnet 10 and to maintain movable member 6 at the gapped position until the next closing operation is executed.

Although only the operation of valve unit 100 during the valve opening period has been discussed hereinabove, the operation during the valve closing period is also executed as is similar to that during the valve opening period. Therefore, the explanation of the operation during the valve closing period is omitted herein.

When the above mentioned landing control is executed, the accuracy of the control is improved by employing a model constant such as mass m, friction c and spring constant k for a controlled system of valve unit 100. However, friction c tends to largely vary according to the change of a temperature particularly to the change of oil temperature. Further, it is not certain that spring constant k is always constant, and rather the spring constant k may vary by each valve at an initial installation, that is, there is a possibility that spring constant k of spring 5, 9 has an individual difference.

With the thus arranged valve control system according to the present invention, it is possible to monitor the characteristic of the free vibration of valve unit 100 by putting both of valve opening and closing electromagnets 10 and 11 in the de-energized condition from a normal operating condition in which one of valve opening and closing electromagnets 10 and 11 put in the energized condition. Therefore, it becomes possible to estimate the friction c of valve unit 100 and the spring constant k of the sum of springs 5 and 9, Such a free vibration is completely executed when the engine is stopped and when both of valve opening and closing electromagnets 10 and 11 are put in the de-energized condition. Further, if a plurality of intake valves or a plurality of exhaust valves are provided for each cylinder of the engine, it is possible to temporally execute such a free vibration of one of valve units 100 for the intake and exhaust valves even during the engine operating condition. In this embodiment according to the present invention, four valve units 100 are installed to each cylinder of the engine. Therefore, by keeping the closed condition of one of two intake valves and by operating another intake valve to intake gas mixture, it becomes possible to execute such a free vibration of valve unit for the temporally resting intake valve. Hereinafter, a condition that one of intake valves or exhaust valves is put in a resting condition is called a single resting condition. That is, by once releasing the resting valve during a low load drive condition and during the single resting condition, it becomes possible to execute the free vibration of the valve unit 100 for the resting valve.

Hereinafter, the control procedure of the valve control system according to the present invention will be discussed. The estimating process of friction c and spring constant k is also discussed with reference to FIGS. 4 to 13.

Figure 4:
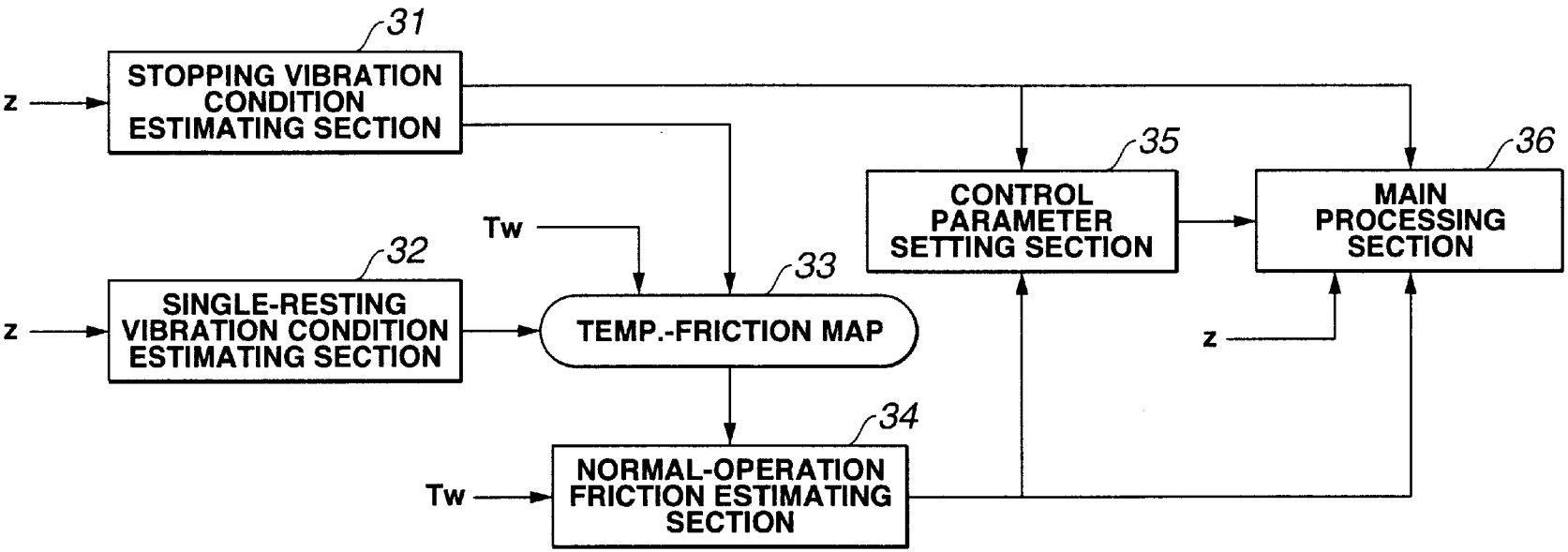
FIG. 4 is a block diagram showing a structure of a controller in the control system.

FIG. 4 shows a block diagram of controller 21 of the valve control system according to the present invention.

A stopping vibration condition estimating section 31 of controller 21 monitors a free vibration obtained by de-energizing the valve unit 100 in the engine stopping condition. On the basis of the obtained characteristic of the free vibration of the resting valve unit 100, stopping vibration condition estimating section 31 estimates friction c at the temperature in this condition and spring constant k of the composition of springs 5 and 9.

A single resting vibration condition estimating section 32 of controller 21 monitors a free vibration obtained by temporally de-energizing the valve unit 100 in the single resting condition. Single resting vibration conditioner estimating section 32 can estimate friction c at the present temperature on the basis of the monitored characteristic of the free vibration. Although it is possible to estimate spring constant k in addition to the estimation of friction c, the aging fluctuation of spring constant k is small as compared with the aging fluctuation of friction c. Further, it is possible to estimate spring constant k by every engine stopping condition as mentioned above. Therefore, in this embodiment, during the single resting condition, the estimation of spring constant k is omitted.

Controller 21 stores friction c estimated at stopping vibration condition estimating section 31 and single-resting vibration condition estimating section 32 and coolant temperature Tw at the estimated period in a map section 33 in the form of a temperature-friction relationship. When the detected coolant temperature Tw corresponds to the coolant temperature stored in the map 33, the estimated friction c at the detected coolant temperature Tw is stored instead of the previously stored friction data.

A normal-operation friction estimating section 34 of controller 21 estimates the friction c at the present temperature on the basis of the detected coolant temperature Tw and with reference to the temperature-friction map 33. When the detected coolant temperature Tw does not correspond to the stored temperature, friction c is interpolated from the stored two temperature-friction data adjacent to the detected coolant temperature.

A control parameter setting section 35 of controller sets an optimum control parameter PRM on the basis of friction c estimated at stopping vibration condition estimating section 31 or normal-operation friction estimating section 34 and spring constant k estimated at stopping vibration condition estimating section 31. For example, the control gain (feedback gain) G of the landing controller shown in FIG. 3 may be varied according to friction c and spring constant k.

A main processing section 36 of controller 21 receives the estimated friction c and the estimated spring constant k and the control parameter PRM and the position signal z. Main processing section 36 outputs energizing commands to drive circuit 23 for energizing valve opening electromagnet 10 and valve closing electromagnet 11, respectively, upon taking account of the received information when main processing section 36 receives valve opening/closing command from an engine control unit 22.

Figure 5:
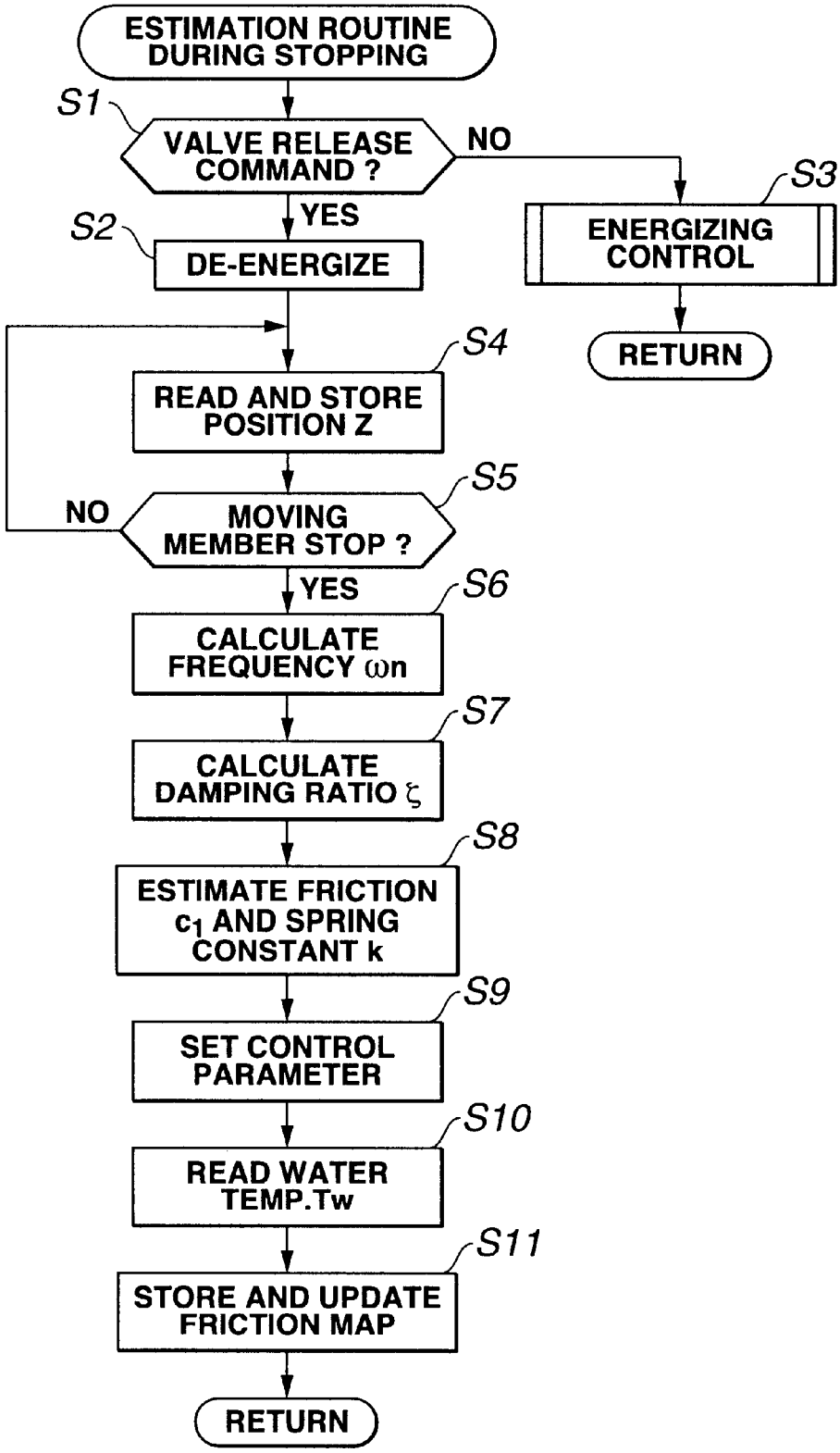
FIG. 5 is a flowchart showing a first vibration condition estimating routine for estimating the vibration condition during an engine stopping condition.

Next, the control procedure of controller 21 will be discussed with reference to a flowchart of FIG. 5, which shows an estimation processing routine fro estimating a vibration condition during an engine stopping condition.

At step S1, controller 21 decides whether engine control unit 22 outputs a valve release command of one of valve units 100 to be checked. When the decision at step S1 is affirmative, the routine proceeds to step S2. When the decision at step S1 is negative, the routine proceeds to step S3.

At step S2, controller 21 commands driver circuit 23 to de-energize both of valve opening and closing electromagnets 10 and 11 of the checked valve unit 100. In reply to this commands, the checked valve unit 100 starts a free vibration.

At step S3 following to the negative decision at step S1, controller 21 commands drive circuit 21 to execute an energizing control for valve opening and closing electromagnets 10 and 11.

At step S4 following to the execution of step S2, controller 21 detects the position z of movable member 6 on the basis of the signal form the position sensor 13 and stores the detected position z.

At step S5, controller 21 decides whether movable member 6 is put in a stationary state or not. When the decision at step S5 is affirmative, the routine proceeds to step S6. When the decision at step S5 is negative, the routine returns to step S4.

At step S6, controller 21 calculates the frequency ωn of the free vibration on the basis of the position information accumulatedly stored.

Figure 6:
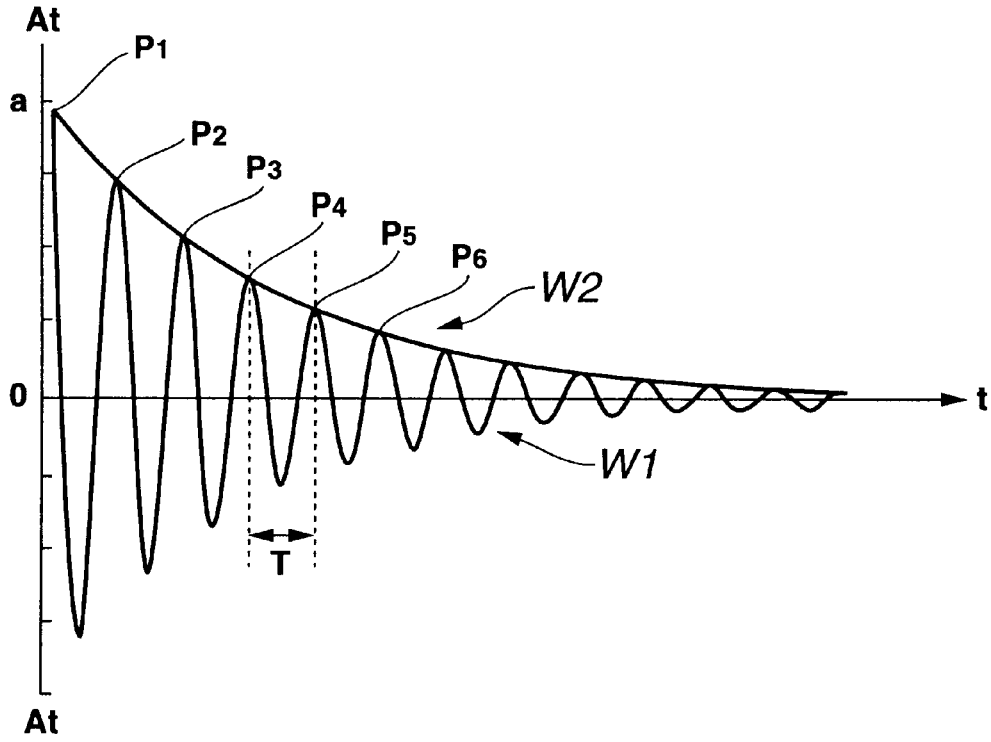
FIG. 6 is a graph showing a waveform of a free vibration of a movable member 6 at the time after an engine is stopped.

At step S7, controller 21 calculates a damping ratio ζ of the free vibration. In this embodiment, on the basis of the stored information as to the position z during the free vibration, controller 21 constructs the wave form W1 of the free vibration as shown in FIG. 6, and calculates the frequency ωn of the free vibration on the basis of the representative cycle of the wave form W1 and the following equation (2).

$$\omega n=2\pi/T \tag{2}$$

Further, controller 21 obtains the damping ratio ζ from a curve W2 which is obtained by connecting peaks P1 to Pn of movable member of the wave form W1. Since curve W2 is approximated by the following equation (3), the damping ratio ζ can be obtained from the information of at least two peaks. More specifically, by detecting time (moment) t and the position z of two peaks (P1 - - - Pn) on the curve W2, the damping ratio can be obtained therefrom.

$$a\times\exp(-\zeta\times\omega n\times t)=At \tag{3}$$

In this equation (3), At is an amplitude at time t of the free vibration W1, and a is a maximum amplitude of the free vibration W1. A distance between the neutral position and the landing position of movable member 6 may be employed as the maximum amplitude of this vibration system. Therefore, in this embodiment, the position z1 shown in FIG. 2 is employed as the maximum amplitude a. Further, the maximum amplitude a may be set at a constant value such as 4 mm. Therefore, if the valve a of the equation (3) has been previously set, it is possible to obtain the damping ratio ζ from the information including time t and position z of one peak and the equation (3). Steps S4 to S7 constitute a free vibration characteristic detecting means.

A step S8, controller 21 estimates friction c and spring constant k on the basis of the calculated frequency ωn and damping ratio ζ. Since the wave form of the free vibration can be theoretically determined on the basis of mass m, friction c and spring constant k of the vibration system, it is possible to estimate the actual friction c and the actual spring constant k from the actually detected frequency ωn and damping ratio ζ and the following equations (4) and (5).

$$k=m\times\omega n^2 \tag{4}$$

$$c=2\times m\times\omega n\times\zeta \tag{5}$$

This step S8 acts as a vibration condition detecting means.

Figure 7:
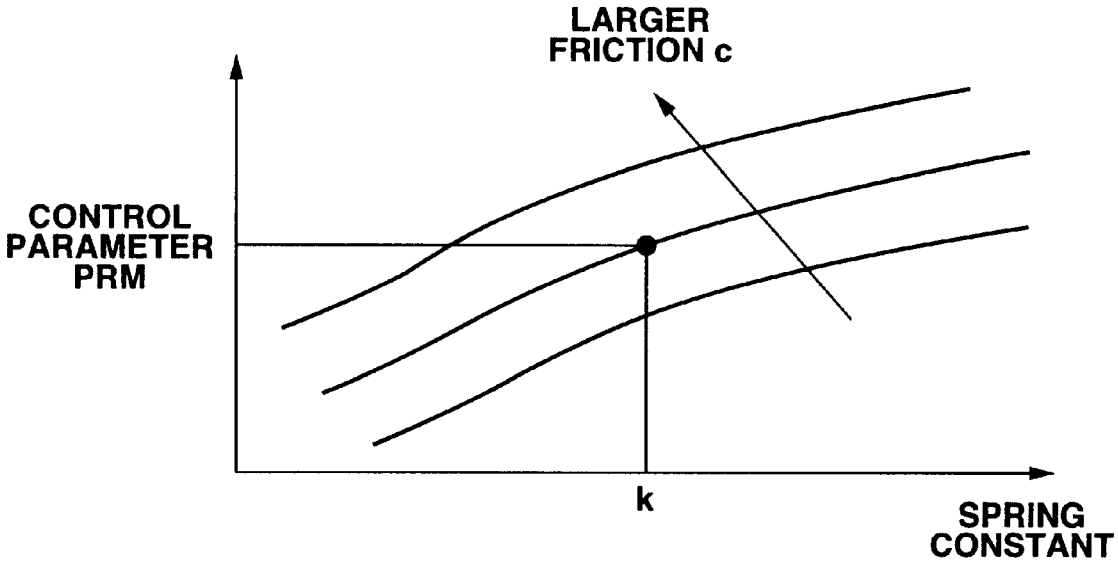
FIG. 7 is a graph showing an example of a map employed for setting a control parameter.

At step S9, controller 21 sets an optimum control parameter PRM with respect to the estimated friction c and spring constant k. For example, the relationship among optimum control parameter PRM, friction c and spring constant k has been previously obtained as shown in FIG. 7 by experiments and stored in a map indicative of this relationship shown in FIG. 7. Accordingly, controller 21 obtains the control parameter PRM employed in the actual control from the map determined on the basis of the estimated friction c and the spring constant k. This step S9 constitutes a control parameter setting means.

The control parameter PRM set at step S9 corresponds with a control gain G employed in the energizing control for electromagnets 10 and 11. If the velocity v of movable member 6 is estimated from an observer of the landing control, friction c and spring constant k may be directly included in designing the observer.

At step S10, controller 21 reads coolant temperature Tw.

Figure 8:
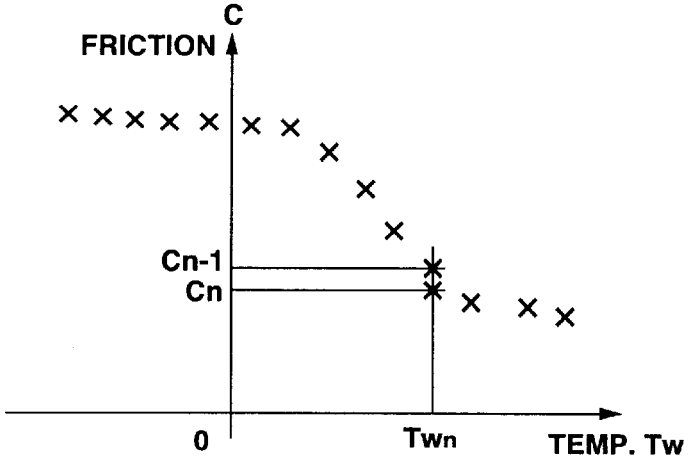
FIG. 8 is a graph showing an example of a temperature-friction map.

At step S11, controller 21 stores the estimated friction c as a relationship to the coolant temperature Tw and updates the temperature-friction map 33 by each estimation of friction c. Referring to FIG. 8, the temperature-friction map 33 at an initial condition has stored only the coordinate axes coolant temperature Tw and friction c, and then gradually increases the information by each estimation time of friction c and the temperature detected. It is preferable to update the map 33 with the new data when coolant temperature Tw of the new data whose corresponding coolant temperature Tw has already been stored is obtained. By this updating operation, the map 33 is gradually perfected, particularly fulfills the data in an ordinary temperature. This step S11 constitutes a friction quantity storing means.

Figure 9:
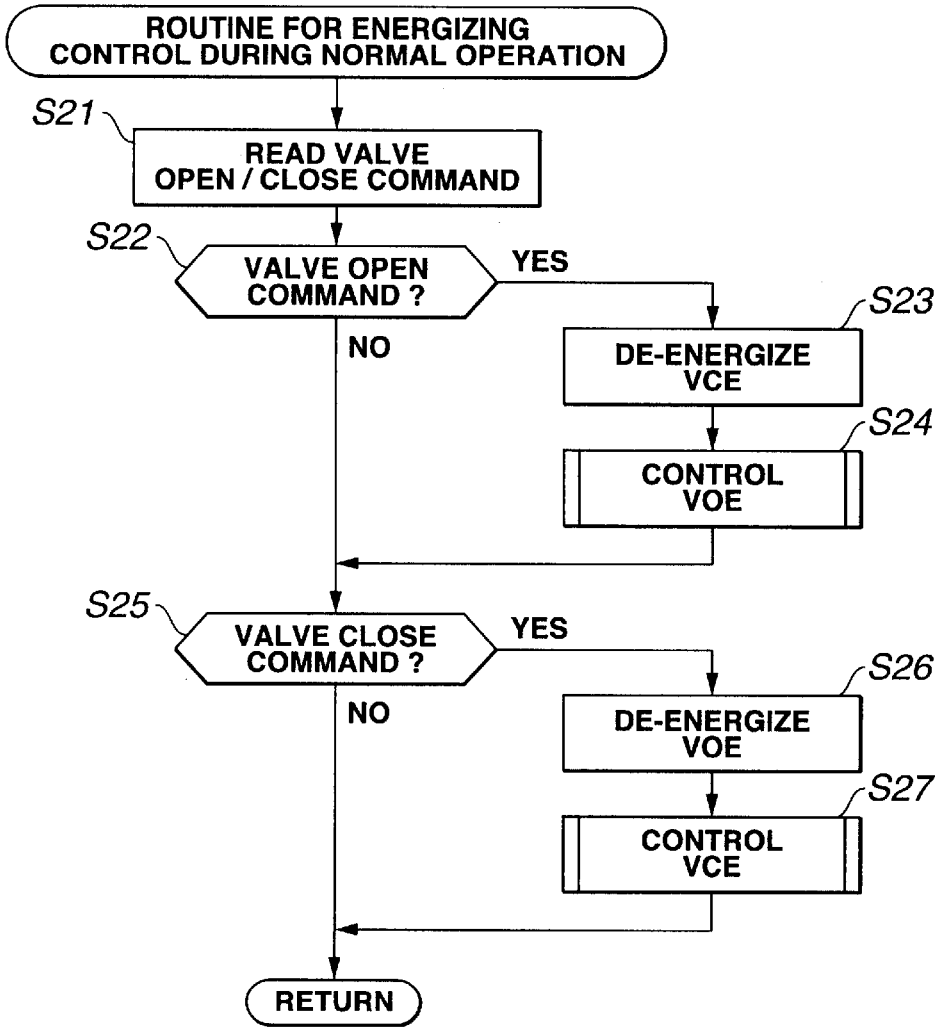
FIG. 9 is a flowchart showing an energizing control routine executed by the controller of the control system.

Next, the normal operation control routine executed by controller 21 will be discussed with reference to a flowchart of FIG. 9.

At step S21, controller 21 reads the valve opening/closing command for each valve unit 100 for each of intake and exhaust valves.

At step S22, controller 21 decides whether the read command is the valve opening command or not.

When the decision at step S22 is affirmative, the routine proceeds to step S23. When the decision at step S22 is negative, the routine proceeds to step S25.

At step S23, controller 21 commands driver circuit 23 to de-energize the valve closing electromagnet (VCE) 11.

At step S24, controller 21 commands drive circuit 23 to energize the valve opening electromagnet (VOE) 10 and to execute the landing control. That is, the routine jumps to the landing control routine shown by a flowchart of FIG. 10. After the execution of the landing control routine as to valve opening electromagnet 10, the routine proceeds to step S25. The landing control routine will be discussed later.

At step S25, controller 21 decides whether the received commands include the valve close command or not. When the decision at step S25 is affirmative, the routine proceeds to step S26. When the decision at step S25 is negative, the routine proceeds to a return step.

At step S26 following to the affirmative decision at step S25, controller 21 commands driver circuit 23 to de-energize the valve opening electromagnet (VOE) 10.

At step S27, controller 21 commands drive circuit 23 to energize the valve closing electromagnet (VCE) 11 and to execute the landing control of the valve closing electromagnet 11. That is, the routine jumps to the landing control routine shown by a flowchart of FIG. 10. After the execution of the landing control routine as to valve closing electromagnet 11, the routine proceeds to the return block.

Figure 10:
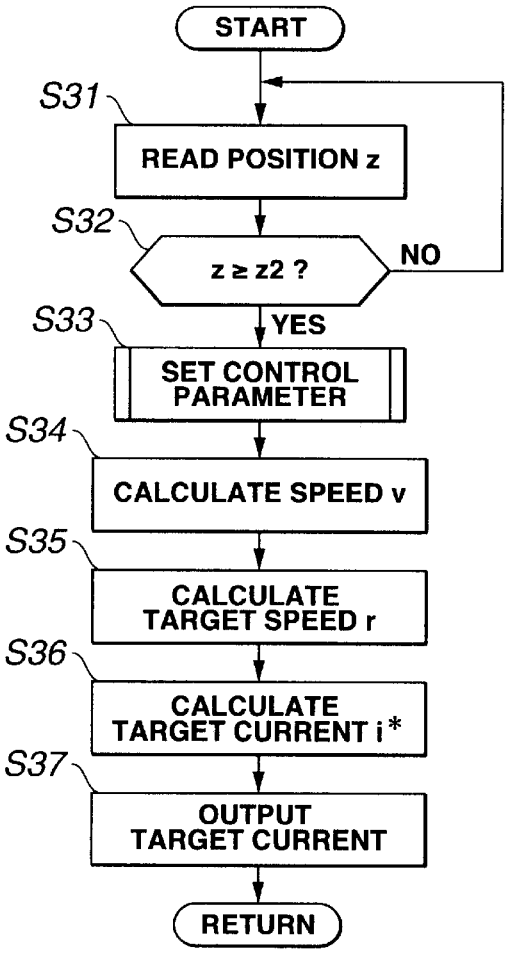
FIG. 10 is a flowchart showing a landing control executed by the controller of the present invention.

Next, the landing control will be discussed with reference to the flowchart of FIG. 10. As mentioned above, this routine is executed as a subroutine at steps S24 and S27, separately.

At step S31, controller 21 reads the position z of movable member 6.

At step S32, controller 21 decides whether the read position z is greater than or equal to the value z2 or not. That is, controller 21 decides whether or not movable member 6 is moved to a position where the electromagnetic force of valve opening electromagnet 10 affects movable member 6 as shown in FIG. 2. When the decision at step S32 is negative ($z<z2$), the routine returns to step S31.

That is, steps S31 and S32 are repeated until the decision at step S32 becomes affirmative. When the decision at step S32 is affirmative ($z\geqq z2$), the routine proceeds to step S33.

At step S33, controller 21 executes the control parameter setting control to set control parameter PRM. More specifically, the routine jumps to the control parameter setting control routine shown by a flowchart of FIG. 11. After the execution of the control parameter setting control, the routine returns to step S34. The control parameter setting routine will be discussed later.

At step S34, controller 21 detects velocity v of movable member 6. In this embodiment; controller 21 obtains velocity v on the basis of position z detected by position sensor 13. More specifically, velocity v of movable member 6 is obtained on the basis of a displacement per a unit time (v=dz/dt), such as a difference ($z_n$–$z_{n-1}$) between a previous position $z_{n-1}$ and a present position $z_n$. Velocity v of movable member 6 may be obtained by providing a velocity sensor for detecting the velocity of movable member 6, or designing an observer of the velocity v and estimating velocity v from this observer. In such a case, it is necessary to determine a model of a condition of a controlled system in order to design the observer of velocity v. Taking account of a friction resistance applied to movable portions of the controlled system (valve unit 100) and the elasticity of springs 5 and 9, friction c and spring constant k are included in the model. Accordingly, if it is possible to estimate friction c and spring constant k according to the condition, these estimations contribute to further accurately estimate velocity v.

At step S35, controller 21 calculates target velocity r. Target velocity r is a function set according to position z of movable member 6, and it is preferable that the target velocity $r_{z2}$ at position z2 is set equal to a velocity $v_{z2}$ derived from the free vibration ($r_{z2}$=$v_{z2}$) when the position z is at a switching start point z2 (z=z2). As to the landing completion point, if it is set that when z=z3 the velocity vz3 is zero (vz3=0), it becomes possible to prevent the collision between movable member 6 and valve opening electromagnet 10 and to stay movable member 6 at a predetermined position until the next valve closing operation.

At step S36, controller 21 calculates a target electric current i* to be supplied to valve opening electromagnet 10 in a manner of obtaining a feedback correction current by multiplying a difference (r–v) between target velocity r and actual velocity v of movable member 6 with control gain G and by adding the feedback correction current to an actual electric current i (i*=G(r–v)+i).

At step S37, controller 21 controls drive circuit 23 to supply target electric current i* to the corresponding electromagnet 10, 11. Consequently, counter electromotive force is generated at the corresponding electromagnet according to the motion of movable member 6, and the electric current to be actually supplied to the electromagnet is determined. Further, the attracting force f of the electromagnet is applied to movable member 6 according to the actual electric current and the position z of movable member 6. A movable section including the movable member 6 is driven by the attracting force f and the biasing force of springs 5 and 9 so that valve member 3 is driven toward the full open position.

Figure 11:
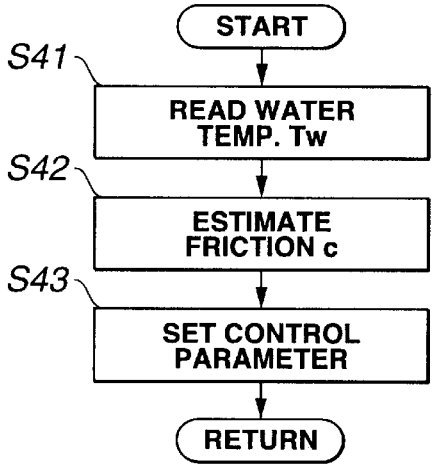
FIG. 11 is a flowchart showing a friction estimating routine for estimating a friction during a normal drive condition executed by the controller.

Next, the control parameter setting control will be discussed with reference to the flowchart of FIG. 11.

At step S41, controller 21 reads coolant temperature Tw.

At step S42, controller 21 estimates friction c with reference to the map 33.

At step S43, controller sets control parameter PRM on the basis of friction c estimated at step S43 and spring constant k estimated at step S8 and with reference to the map shown in FIG. 8. After the execution of step S43, the routine returns to the routine of the landing control.

Figure 12:
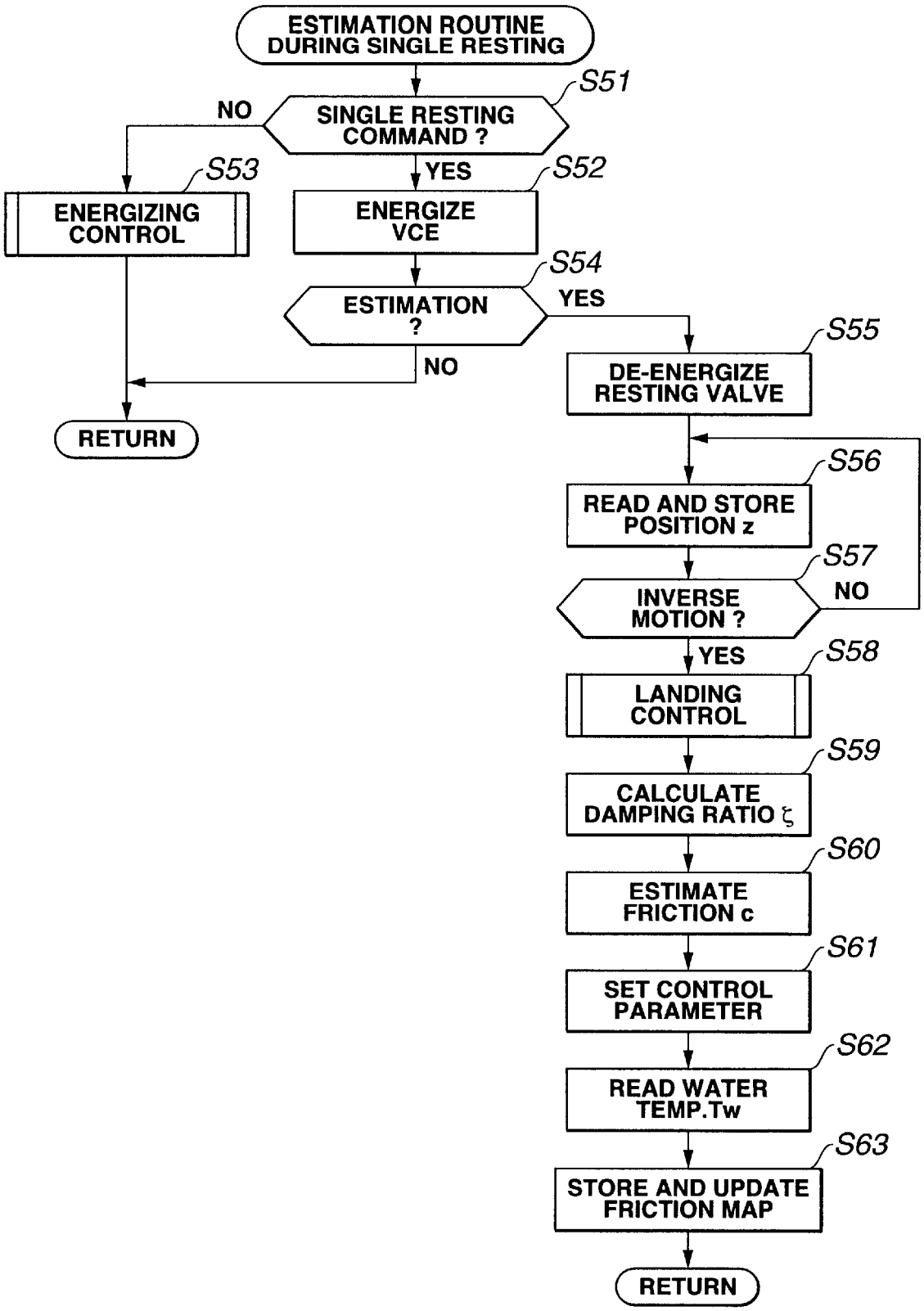
FIG. 12 is a flowchart showing a second vibration condition estimating routine for estimating a vibration condition during a single resting condition.

With reference to a flowchart of FIG. 12, the vibration condition estimating routine for estimating the vibration condition of the vibration system during the single resting condition will be discussed.

At step S51, controller 21 decides whether engine control unit 22 outputs a single resting command. When the decision at step S51 is affirmative, the routine proceeds to step S52. When the decision at step S51 is negative, the routine jumps to step S53.

At step S52, controller 21 commands drive circuit 23 to energize valve closing electromagnet 11 of valve unit 100 to be set in a resting state. By the execution of step S52, the corresponding intake valve is maintained at the closed state. That is, the corresponding intake valve is put in the resting condition.

At step S53 following to the negative decision at step S51, controller 21 executes the normal energizing control for each of electromagnets 10 and 11. After the execution of step S53, the routine proceeds to a return step.

At step S54 following to the execution of step S54, controller 21 decides whether the estimation of friction c is executed or not. When the decision at step S54 is affirmative, the routine proceeds to step S55. When the decision at step S54 is negative, the routine jumps to the return step to maintain the closing condition of the intake valve.

At step S55, controller 21 commands drive circuit 23 to de-energize the electromagnet of the resting valve, that is, to de-energize valve closing electromagnet 11 in order to start the free vibration of the resting valve unit 100.

At step S56, controller 21 detects the position z of movable member 6 on the basis of the signal from position sensor 13 and stores the detected position z.

At step S57, controller 21 decides whether movable member 6 has moved inversely or not. It is possible to detect the inverse motion of movable member 6 by deciding whether velocity v of movable member 6 becomes zero at the first time after valve closing electromagnet 11 releases movable member 6 in the resting state. When decision at step S57 is negative, the routine returns to step S56 to repeat steps S56 and S57 until the decision at step S57 becomes affirmative. When the decision at step S57 is affirmative, the routine proceeds to step S58.

At step S58, controller 21 executes the landing control of valve closing electromagnet 11 to smoothly and softly land movable member 6 on valve closing electromagnet 11.

Figure 13:
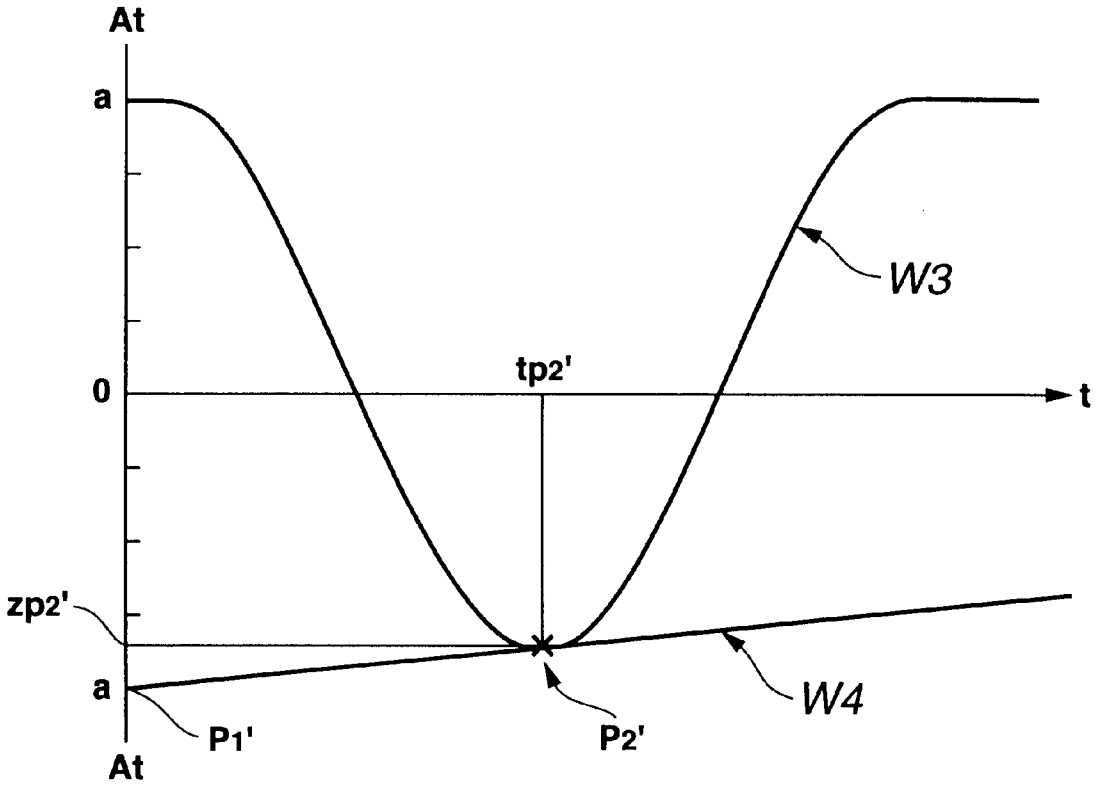
FIG. 13 is a graph showing a waveform of a temporal free vibration of movable member during the single resting condition.

At step S59, controller 21 calculates damping ratio ζ. In this embodiment, controller 21 partially obtains a free vibration wave form W3 shown in FIG. 13 by accumulating the position z stored at step S56 until detecting the inverse motion of movable member 6. On the basis of the obtained wave form W3, at least two peaks P1' and P2' of the displacement of movable member 6 are detected, and damping ratio ζ is estimated from the line W4 connecting the peaks P1' and P2' of wave form W3 as shown in FIG. 13.

Since the wave form W3 can be approximated by the equation (3) under the condition that the maximum amplitude a is z1 (a=z1), damping ratio ζ may be obtained by the equation (3) and the time $t_{P2'}$ and the position $z_{P2'}$ of one peak P2'. Further, spring constant k may be estimated by approximately obtaining a cycle T in a manner of multiplying 2 with the time period between the peaks P1' and P2'. In this routine, step S56, S57 and S58 constitute a free vibration characteristic detecting means.

At step S60, controller 21 estimates friction c on the basis of the calculated damping ratio 4 and the frequency on of the free vibration and the equation (5).

At step S61, controller 21 sets optimum control parameter PRM according to the estimated friction c and the spring constant k with reference to the map shown in FIG. 8. This step S61 constitutes a second control parameter setting means. The control parameter PRM set at step S61 may relate to control gain G employed in the energizing control of electromagnets 10 and 11. When velocity v of movable member 6 is estimated by means of the observer in the landing control, friction c estimated at step S60 may be directly employed in the design of the observer.

At step S62, controller 21 detects coolant temperature Tw.

At step S63, controller 21 stores the estimated friction c and the coolant temperature Tw at the time of the estimation of friction c into the temperature-friction map 33. The map 33 can be updated even during the single resting period. This step S63 constitutes a friction quantity storing means.

With the thus arranged control system according to the present invention, it is possible to estimate an actual friction at the temperature at the timing of the single resting, and therefore it becomes possible to increase the times of the estimations of the actual friction c. Accordingly, it becomes possible to improve the relationship between the friction c and the temperature for the landing control.

Although the embodiment according to the present invention has been shown and described such that control parameter PRM is set on the basis of the estimated friction c and spring constant k, the present invention is not limited to this and may be arranged to estimate friction c and spring constant k even when the setting of the control parameter is not set. Further, control parameter PRM may be simply set on the basis of one of the estimated friction c and the estimated spring constant k, or one of the friction c and the estimated spring constant k may be estimated and the other may employ an initial valve thereof.

The entire contents of Japanese Patent Application No. 2000-166532 filed on Jun. 2, 2000 in Japan are incorporated herein by reference.

Although the invention has been described above by reference to certain embodiments of the invention, the invention is not limited to the embodiments described above. Modifications and variations of the embodiments described above will occur to those skilled in the art, in light of the above teaching. The scope of the invention is defined with reference to the following claims.

What is claimed is:

1. A method for controlling an electromagnetic valve unit, the electromagnetic valve unit being arranged to operate a valve by electromagnetically controlling a pair of electromagnets so as to displace a movable member disposed in a space between the electromagnets which receiving biasing force of a pair of springs, the method comprising:

detecting a characteristic of a free vibration of a vibration system in the electromagnetic valve unit when both electromagnets are de-energized; and estimating at least one of a friction quantity and a spring constant of the vibration system on the basis of the detected characteristic of the free vibration.

2. A valve control system comprising:

an electromagnetic valve unit comprising a valve, a pair of electromagnets arranged in spaced relationship from one another in axial alignment with the valve so as to form a space, a movable member axially movably disposed in the space between the electromagnets, the movable member being interlocked with the valve, a pair of springs biasing the movable member so as to locate the movable member at an intermediate portion of the space when both of the electromagnets are de-energized; and a controller connected to said electromagnetic valve unit, said controller energizing and de-energizing each of said electromagnets to reciprocatingly displace the valve, said controller being arranged to detect a characteristic of a free vibration of a vibration system in said electromagnetic valve unit when both electromagnets are de-energized, and to estimate at least one of a friction quantity and a spring constant of the vibration system on the basis of the detected characteristic of the free vibration.

3. The control system as claimed in claim 2, wherein said controller controls electric current to be supplied to electromagnets to control the operation of the valve.

4. The control system as claimed in claim 2, wherein said controller controls electric current to be supplied to electromagnets based on the estimated characteristic of the vibration system of said valve unit.

5. The control system as claimed in claim 4, wherein said controller determines a control parameter employed for controlling the electric current to be supplied to said electromagnets, on the basis of at least one of the friction quantity and the spring constant.

6. The control system as claimed in claim 2, wherein said controller detects an actual damping ratio of the vibration system as the characteristic of the vibration system.

7. The control system as claimed in claim 2, wherein said controller detects one of a cycle and a frequency of the free vibration as a characteristic.

8. The control system as claimed in claim 2, wherein said controller generates the free vibration of the vibration system by de-energizing both of the electromagnets when said electromagnetic valve unit is put in a stopped condition.

9. The control system as claimed in claim 2, wherein said controller generates the free vibration by de-energizing the electromagnet, which is of said electromagnetic valve unit adapted to one of the plurality of valves and which has been energized to keep the valve in a close condition, when the control system is adapted to control intake and exhaust valves of an internal combustion engine and when a plurality of intake valves or a plurality of exhaust valves are provided to each cylinder of the engine.

10. The control system as claimed in claim 2, wherein said controller detects a temperature indicative of a temperature of lubrication oil for the engine, and said controller stores the estimated friction quantity with the temperature at the estimated condition.

11. The control system as claimed in claim 10, wherein said controller determines a control parameter employed for controlling electric current to be supplied to said electromagnets, on the basis of at the friction quantity stored in said controller.

12. An engine valve control system for electromagnetically controlling each of intake and exhaust valves of an internal combustion engine, said valve control system comprising:

an electromagnetic valve unit comprising a pair of electromagnets arranged in spaced relationship from one another in axial alignment with the valve so as to form a space, a movable member axially movably disposed in the space between the electromagnets, the movable member being contacted with the valve, a pair of springs biasing the movable member so as to locate the movable member at an intermediate portion of the space when both of the electromagnets are de-energized; and a controller connected to said electromagnetic valve unit, said controller detecting a characteristic of a free vibration of a vibration system in said electromagnetic valve unit when both electromagnets are de-energized, said controller estimating at least one of a friction quantity and a spring constant of the vibration system on the basis of the detected characteristic of the free vibration, said controller controlling said electromagnetic valve unit on the basis of a control parameter determined by one of the estimated friction quantity and the estimated spring constant so as to reciprocatingly displace the valve between an opening state and a closing state.

13. A control system for controlling an electromagnetic valve unit, the electromagnetic valve unit comprising a valve, a pair of electromagnets arranged in spaced relationship from one another in axial alignment with the valve so as to form a space, a movable member axially movably disposed in the space between the electromagnets while being interlocked with the valve, and a pair of springs biasing the movable member so as to locate the movable member at an intermediate portion of the space when both of the electromagnets are de-energized, the control system comprising;

free-vibration characteristic detecting means that detects a characteristic of a free vibration of a vibration system in the electromagnetic valve unit when both electromagnets are de-energized;

vibration-condition estimating means that estimates at least one of a friction quantity and a spring constant of the vibration system on the basis of the detected characteristic of the free vibration; and controlling means controlling electric current supplied to the electromagnets based on the estimated one of the friction quantity and the spring constant to reciprocatingly displace the valve.

* * * * *